US005325839A

United States Patent [19]

Scheffer

[11] Patent Number: 5,325,839

[45] Date of Patent: Jul. 5, 1994

[54] SPRING BIASED ARROW REST

[76] Inventor: Darrell J. Scheffer, 32765 SE. Compton Rd., Boring, Oreg. 97009-9001

[21] Appl. No.: 89,696

[22] Filed: Jul. 9, 1993

[51] Int. Cl.[5] ..... F41B 5/22

[52] U.S. Cl. ..... 124/44.5; 124/24.1

[58] Field of Search ..... 124/23.1, 24.1, 25.6, 124/44.5, 86, 88

[56] References Cited

U.S. PATENT DOCUMENTS

| | | | |
|---|---|---|---|
| 3,769,956 | 11/1973 | Simo | 124/44.5 |
| 3,828,757 | 8/1974 | Finlay | 124/44.5 |
| 4,074,674 | 2/1978 | Simo | 124/44.5 |
| 4,548,188 | 10/1985 | Simo | 124/44.5 |
| 4,686,956 | 8/1987 | Troncoso | 124/44.5 |
| 4,732,135 | 3/1988 | Simo | 124/44.5 |
| 4,809,670 | 3/1989 | Simo | 124/44.5 |
| 4,881,515 | 11/1989 | Simo | 124/24.1 |
| 5,117,803 | 6/1992 | Johnson | 124/44.5 |
| 5,179,930 | 1/1993 | Simo | 124/44.5 |
| 5,249,565 | 10/1993 | Saunders et al. | 124/44.5 |

*Primary Examiner*—Randolph A. Reese
*Assistant Examiner*—John A. Ricci

[57] ABSTRACT

An arrow rest for an archery bow having an arrow support arm that pivots in two directions from an initial arrow receiving position, on a generally horizontal plane, and automatically returns to the initial position after being displaced in either direction. Two springs cooperate to locate and maintain the arrow support arm in the initial position and act to cushion each other during operation. A first spring, of predetermined tension, returns the arrow support arm to said initial position after being displaced by an arrow being discharged from the bow and is cushioned upon return by a second spring, of higher tension, which then cooperates to locate the arrow support arm in said initial position. If the arrow support arm is accidently forced essentially backwards of normal rotation said second spring will return the arrow support arm to said initial position where said first spring will first cushion and then cooperate to locate the arrow support arm in said initial position. The arrow rest has the unexpected ability to be assembled for either right handed or left handed bows using the exact same parts. The arrow rest is easily mounted on a suitable cushion plunger, of conventional design, and may be mounted and remounted with complete assurance of maintaining the proper position and alignment with respect to the bow. By mounting the arrow rest on said cushion plunger the rest gains easy lateral adjustment and adjustable cushioning for lateral thrust.

9 Claims, 1 Drawing Sheet

SPRING BIASED ARROW REST

FIELD OF INVENTION

This invention relates to an arrow rest for an archery bow, specifically to a more durable, quieter and field replaceable arrow rest.

DESCRIPTION OF PRIOR ART

An arrow rest is generally secured to the handle area of an archery bow and often includes a rigid notch or ledge which supports and guides an arrow as it is discharged from the bow. However, a rigid arrow rest may introduce undesirable vertical and horizontal force components to the arrow when the shaft and fletch pass over the arrow rest, causing unwanted deflection of the arrow and possible damage to the fletching.

Clearance and control problems are magnified by the lateral flexing of the arrow shaft, known to those skilled in the art as "archer's paradox". This lateral flexing is caused by the deflection of the string as it slides or rolls of the end of the archer's fingers at the time of release.

Many recognised experts in the field of archery agree that spring biased arrow rests are the best rest for finger shooters when used with a cushion plunger to control lateral thrust. These provide an arrow support arm that is pivoted out of the way by the forward movement of an arrows shaft and fletching and automatically return to an initial arrow receiving position after discharge of the arrow.

A spring biased arrow rest that uses a single spring to provide both a bias means and control of lateral thrust is disclosed in U.S. Pat. No. 3,828,757 to Finlay (1974). Spring biased arrow rests that may be used with or without a cushion plunger are disclosed in U.S. Pat. Nos. 3,769,956 to Simo (1973) and 4,074,674 to Simo (1978). Spring biased arrow rests that are lateraly adjustable are described in U.S. Pat. Nos. 4,548,188 to Simo (1985), 4,732,135 to Simo (1988), 4,809,670 to Simo (1989). Arrow rests that are laterally adjustable and field replaceable are disclosed in U.S. Pat. No. 4,881,515 to Simo (1989).

The same experts point out a major problem with spring biased arrow rests. That being how quickly and easily this style of rest is broken. If the arrow support arm is pushed back against the hard face or stop that locates it in the initial arrow receiving position, it is destroyed. Even being lightly brushed against the archers clothing, a small branch or a vine will break the rest. This problem has existed since the first flipper style rest was built about twenty years ago and is still the number one flaw in this design. Another problem is the audible snap created by the arrow support arm striking the hard stop. Not loud by human standards, it is more than loud enough to spook wary game animals.

An improvement to a spring biased arrow rest sold under U.S. Pat. No. 4,881,515 to Simo (1989), but not disclosed in this or any of the prior art patents, does attempt to address this problem. The improvement consists of using a flexible stop to locate the arrow rest in the initial position. If forced essentially backwards of normal rotation, this flexible stop moves aside and allows the arrow support arm to rotate essentially backwards without destroying the rest. While this improvement does stop total destruction of the rest, it leaves the rest in an unusable condition. To return the rest to a usable condition, the archer must manually reset it. While this manual resetting is just an inconvenience to the target archer, the time and movement required to reset the rest could cost the hunting archer the opportunity of a lifetime. Additionally, the metal stop used increases the game spooking "snap" caused when the returning arrow support arm strikes it. Many archers use arrow rests that are less effective than a flipper style rest, but offer increased durability. Many other archers use flipper style rests for target shooting and other, more durable, rests for hunting.

The reader will note that six of the seven U.S. Patents are to Mr. Simo. As head of New Archery Products Corp. Mr. Simo is a recognised expert in the field of spring biased arrow rests. The dates of Mr. Simos various patents and the various embodiments disclosed in them are evidence of his continued search for a better or improved spring biased arrow rest. The fact that a recognised expert in the field, who has actively searched for an improved design, has failed to realize the benefits of my design should be recognised as evidence as to the unobviousness of my arrow rest.

OBJECTS AND ADVANTAGES

Accordingly several objects and advantages of my arrow rest are:

(a) to provide an arrow rest having an arrow support arm which may be easily deflected by the movement of the shaft and fletching of an arrow and automatically returns to its initial position after discharge of the arrow.

(b) to provide an arrow rest with an arrow support arm that is not destroyed if forced backwards of its normal rotation.

(c) to provide an arrow rest with an arrow support arm that will automatically return to its initial position after being forced backwards of its normal rotation.

(d) to provide an arrow rest with cushioning action at all stops for quieter operation.

(e) to provide an arrow rest that is very compact to allow total fletching clearance.

(f) to provide an arrow rest that is easy to install assuredly in the manufactures preferred location.

(g) to provide an arrow rest that is affordable to manufacture.

(h) to provide an arrow rest that may be easily removed and replaced without affecting the tuning or sighting of the bow.

Still further objects and advantages will become apparent from a consideration of the ensuing description and drawings.

BRIEF DESCRIPTION OF DRAWINGS

In the drawings closely related figures have the same number but different alphabetic suffixes.

Figure 1:
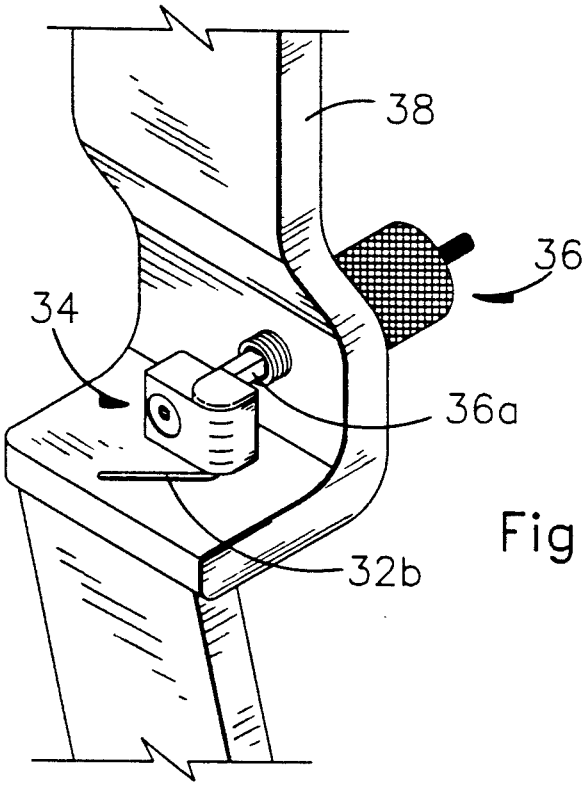
FIG. 1 is a perspective view of one proven embodiment of my arrow rest mounted on a suitable cushion plunger, of conventional design, which is mounted on a section of a modern centershot bow.

| REFERENCE NUMERALS IN DRAWINGS | | | |
|---|---|---|---|
| 20 | body | 20a | cap |
| 22 | mounting screw recess | 24 | plunger index cavity |
| 26 | spring chamber | 26a | front stop |
| 26b | back stop | 28 | journaling sleeve |
| 30 | first spring | 30a | upper end |
| 30b | lower end | 31 | second spring |
| 31a | upper end | 31b | lower end |
| 32 | arrow support wire | 32a | spring contact |
| 32b | arrow support arm | 34 | my arrow rest |
| 36 | cushion plunger assembly | 36a | cushion plunger slide |
| 38 | centershot bow section | | |

DESCRIPTION OF FIG. 1 thru 4

In FIG. 1 one proven embodiment of my arrow rest 34 is shown mounted on a centershot bow section 38 via a suitable cushion plunger assembly 36. Assembly 36, of a proven conventional design, is particularly well suited for this application by virtue of its having a plunger slide 36*a* with an essentially square shape. This square shape mounts slide 36*a* non-rotatably in assembly 36, which allows it to maintain rest 34 in the proper rotational orientation. Furthermore, since the outer end of slide 36*a* is internally threaded to accept, and includes, a conventional countersunk machine screw, it is well adapted to readily accept rest 34. By mounting rest 34 directly on assembly 36 positive, replaceable mounting is achieved and easy lateral adjustment, fully adjustable cushioning of lateral thrust and mounting in the manufacturers preferred location are gained. Also, mounted in this manner, rest 34 may be easily replaced at any time without affecting the "fine tuning" of the bow. "Fine tuning" refers to the lateral adjustments made to rest 34, spring tension adjustments to assembly 36 and other adjustments made to a bow such as nocking point and tiller that individual archers make to obtain the best arrow flight possible from their bows.

Figure 2:
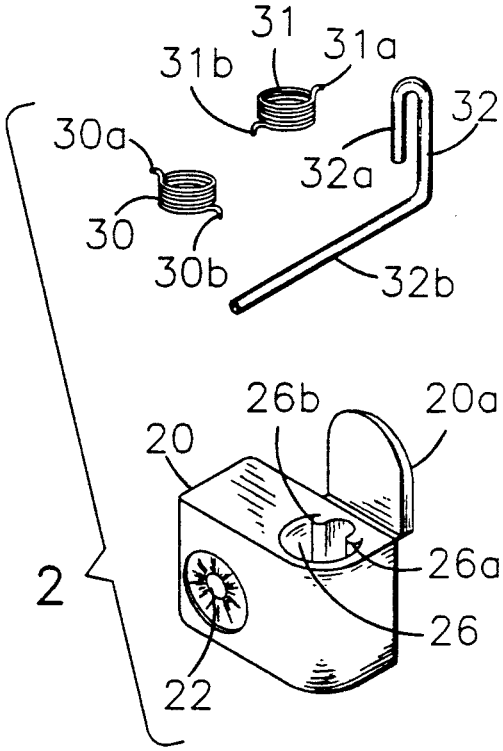
FIG. 2 is an exploded perspective view of my arrow rest.

The exploded view of rest 34 shown in FIG. 2 discloses the four individual parts of rest 34. An unexpected but very desirable benefit of my design is the ability to create both left and right handed models using the same parts. Most arrow rests, including all prior spring biased arrow rests, require mirror images of one or more parts to create both left and right handed models. Thus my arrow rest provides reduced production costs through lower mold and machining costs and the ability to order larger quantities of individual parts.

Referring now to the individual parts shown in FIG. 2, in the preferred embodiment being described, an injection molded housing or body 20, while one piece, is composed of two basic portions. A substantially rectangular main portion containing a generally horizontal through hole comprising mounting screw recess 22. Recess 22 is set off center, in relation to the face of body 20, and has a countersunk first end and an essentially square recessed aperture or cavity 24 at its second end. Recess 22 is sized to fit the standard machine screw provided with assembly 36. Cavity 24 is sized for a tight fit on slide 36*a* and provides positive mounting each quarter turn of assembly 36. Since lateral adjustments to one of the embodiments of assembly 36 is made by threading it into or out of the bows conventional cushion plunger hole, providing positive mounting of rest 34 each one-quarter turn of assembly 36 allows minute lateral adjustments while assuring proper positioning of rest 34.

A second substantially vertical through hole is offset from recess 22 and comprises a journaling sleeve 28 with an enlarged upper space or spring chamber 26. Sleeve 28 is sized to support and rotatably contain an arrow support wire 32. Chamber 26 is sized to contain and allow free movement to a spring contact 32*a*, a first spring 30, and a second spring 31. Included in chamber 26 are a front stop 26*a* and a back stop 26*b*. At the point which sleeve 28 widens into chamber 26 a flat bottom is formed.

A substantially smaller second portion is attached to the main portion by a thin flexible membrane. This seal or cap 20*a* is sized and located properly to close chamber 26 when folded over.

Wire 32 has an upper portion bent at essentially 180 degrees and spacially set apart from and paralell to wire 32 to form contact 32*a*. While wire 32 is also shown with a lower portion bent at essentially 90 degrees, in direct radial alignment with the bend that formed contact 32*a* to form an arrow support arm 32*b*, the reader should realize that arm 32*b* would normally be formed after assembly.

Spring 30, of pre-determined tension stainless steel spring wire, is coiled or wound counter-clockwise. An upper end 30*a* and a lower end 30*b* extend beyond the outside diameter of the coils formed. Each end, 30*a* and 30*b*, has a generally curved shape to conform to contact 32*a* and thus stops 26*a* and 26*b* and are slightly shorter than the diameter of wire 32. In the preferred embodiment being described, the face or inside of ends 30*a* and 30*b* are spaced 240 degrees apart. If spring 30 were inverted, ends 30*a* and 30*b*, while reversed, would be the same and are only designated with numerals to make assembly instructions more understandable.

Spring 31, of higher tension stainless steel spring wire than spring 30, is coiled or wound clockwise. An upper end 31*a* and a lower end 31*b* extend beyond the outside diameter of the coils formed. Each end, 31*a* and 31*b*, has a generally curved shape to conform to contact 32*a* and thus stops 26*a* and 26*b* and are slightly shorter than the diameter of wire 32. In the preferred embodiment being described, the face or inside edge of ends 31*a* and 31*b* are spaced 195 degrees apart. If spring 31 were inverted, ends 31*a* and 31*b*, while reversed, would be the same and are only designated with numerals to make assembly instructions more understandable.

Figure 3:
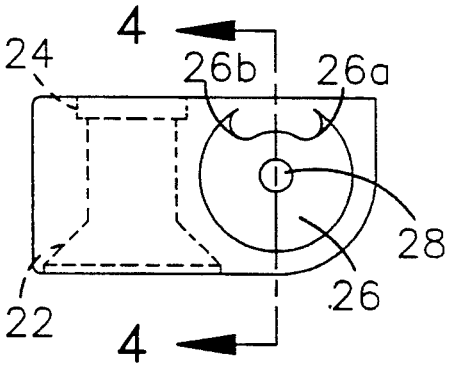
FIG. 3 is a top view of body 20 with cap portion 20*a* removed to best show the design of chamber 26.

In FIG. 3 cap 20*a* has been removed to best show the design of chamber 26 with stops 26*a* and 26*b* and sleeve 28. Recess 22 and cavity 24 are also shown via hidden lines. Stops 26*a* and 26*b* are located approximately 120 degrees apart or about 60 degrees in front of and about 60 degrees behind an imaginary line from the center of sleeve 28 and parallel to recess 22, suitably shown here as line 4—4. The face or outer radius of stops 26*a* and 26*b* are identical to the radius of wire 32. Stops 26*a* and 26*b* provide contact points for springs 30 and 31 and maximum rotational stops for contact 32*a*.

Figure 4:
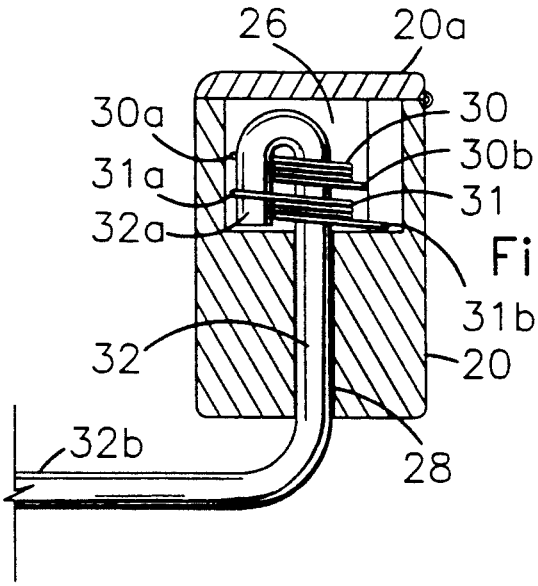
FIG. 4 is an archers side view of my arrow rest with body 20 cutaway cross-sectionally along line 4—4 of FIG. 3 to best show the assembled relationship of the parts.

In FIG. 4 body 20 and cap 20*a* have been cutaway cross-sectionally substantially along line 4—4 of FIG. 3 to best show the assembled position and relationship of the parts. Arm 32*b*, and thus contact 32*a*, springs 30 and 31, has been rotated back approximately 45 degrees, placing arm 32*b* in direct alignment with line 4—4 of FIG. 3, to provide the reader with the best, most understandable view. It should be understood that arm 32*b* would normally rest at approximately 45 degrees foward in relation to the face of rest 34. The face being the same side of rest 34 that recess 22 is countersunk on.

To assemble rest 34, as shown in FIG. 4, the free end of wire 32, with contact 32*a* formed, is guided through springs 30 and 31 respectively. Ends 30*a* and 31*a*, being those ends closest to the closed end of wire 32, are rotated until their faces or the inside edge of the curves, abut contact 32*a*. The free end of wire 32 is then guided through chamber 26 and sleeve 28. When contact 32*a* and springs 31 and 30 respectively start to enter chamber 26, ends 31*b* and 30*b* respectively are separated and end 31*b* is slid down stop 26*a* and end 30*b* is slid down stop 26*b* until the free end of contact 32*a* strikes the bottom of chamber 26. Wire 32 is then bent at substantially a 90 degree angle, at the point it exits sleeve 28, to form arm 32*b*. Cap 20*a* is folded over and glued or otherwise suitably adhered.

Assembled thus, as shown in FIG. 4, rest 34 would be suitible for use by right handed archers. To create a rest for left handed archers, the following changes would be made during assembly. Springs 30 and 31 would be rotated until ends 30*b* and 31*b* abutted contact 32*a*. Then end 31*a* would be slid down stop 26*b* and end 30*a* would be slid down stop 26*a*.

From the above description, a number of advantages of my arrow rest become eveident;

(a) the unexpected ability to create both left and right-handed models from the same parts greatly reduces production and inventory costs.

(b) since rest 34 maintains arm 32*b* in the arrow recieving position by the coordination of springs 30 and 31, it is not rendered useless or destroyed if accidently brushed or forced backwards of normal rotation.

(c) rest 34 is easy to mount and remount assuredly in the same position and alignment, in respect to the bow.

(d) by mounting directly to a proven cushion plunger 36, easy lateral adjustments and adjustable cushioning for lateral thrust are gained.

(e) mounting in the preferred factory location is assured by mounting in the factory plunger hole supplied on modern bows.

(f) the cushioning action of my dual spring design provides quieter operation.

(g) since the dual spring design of rest 34 returns arm 32*b* to the initial position reguardless of the direction of displacement, it is more dependable than prior spring biased arrow rests.

OPERATION FIGS. 1 and 4

Properly assembled, spring 30 will urge contact 32*a* to pivot outward and back until contact 32*a* abuts spring 31. Spring 31, being of greater tension, resists spring 30 and stops contact 32*a* and thus arm 32*b* at approximately 45 degrees in relation to the face of rest 34. This places arm 32*b* generally across and along the path of an arrow placed on the rest, the initial arrow receiving position. While spring 30 has enough tension to maintain position during the mounting of the arrow, and subsequent actions prior to launch, it is easily displaced by the forward motion of the arrows shaft and fletching, allowing an essentially deflection free launch. After the arrow has passed, spring 30 will urge contact 32*a* back to the initial position where spring 31 first cushions the impact and then, overpowering spring 30, locates contact 32*a* in the initial position.

Spring 31 is strong enough to resist the friction of an arrow being drawn across arm 32*b*, but will allow arm 32*b* to pivot essentially backwards of normal rotation if forced. Once the obstruction is passed or cleared, spring 31 will urge arm 32*b* back to the initial position where spring 30 will first cushion the impact and then cooperate with spring 31 to re-establish the initial position, whereby the problem of being destroyed or rendered useless is solved and a quieter rest is created.

Assembly 36 is mounted on the bow in the normal manner and rest 34 is attached with the mounting screw provided by placing the screw through recess 22 and into the threaded end of slide 36*a*. Rest 34 is rotated as necessary to align slide 36*a* and cavity 24. Exact rotational positioning and lateral adjustments are made by either rotating assembly 36 and then loosening the mounting screw in slide 36*a* and rotating rest 34 into proper position, or, in some models of assembly 36, by tightening assembly 36 and mounting rest 34 in the proper orientation and then adjusting slide 36*a* in or out as required. Once "rough tuning" has been accomplished, "fine tuning" may be done in several manners, many books having been written on the subject.

It is important to note that, though my arrow rest is shown mounted on a modern centershot riser, my arrow rest may be readily used with most custom mounts and overdraws, making it easily adaptable for use on any modern bow. The design and use of such mounts being well known to those skilled in the art.

The components of my arrow rest may be constructed of suitable materials providing weather resistance and durability. Many suitable metals and moldable plastics will be readily apparent to those skilled in the art. Also, while not required or even particularly desireable for certain applications such as bowfishing, individual archers may add felt pads and or friction reducing sleeves of PTFE to additionally quiet my arrow rest. The use of such materials being well know to those skilled in the art.

SUMMARY, RAMIFICATIONS and SCOPE

Accordingly the reader will see that my arrow rest may be easily mounted and used on any modern bow. That it solves the problem of being easily rendered useless or destroyed and operates much quieter than prior rests. Furthermore, my arrow rest has the additional advantages in that;

it permits the production of left and right-handed models from the same parts.

it permits easy field replacement without affecting the "tune" of the bow.

mounting on a proven cushion plunger allows easy lateral adjustment.

mounting on a proven cushion plunger provides adjustable cushioning for lateral thrust.

mounting on a cushion plunger provides easy mounting in the manufactures preferred location.

it provides reduced production and inventory costs.

Although the above description contains many specifications, these should not be construed as limiting the scope of the invention, but as merely providing one of the presently preferred embodiments of this invention. For example; while the dual spring design of my arrow rest is shown and described adapted to provide an arrow support arm 32*b*, the same dual spring design could be used to provide an arrow retaining arm. Furthermore, by combining two of my dual spring designs in a properly adapted body, an extremely durable and quiet arrow rest that holds the arrow on the rest would be created. Also, while the preferred embodiment described mounts on a convention cushion plunger, the reader will see that my dual spring design would be easily adaptable to other mounting means.

Thus, the scope of the invention should be determined by the appended claims and there legal equivalents, rather than by the examples given.

I claim:

1. An arrow rest for an archery bow having an arrow support arm that pivots, on a generally horizontal plane, from an initial arrow receiving position, and returns automatically to said initial position after being displaced, comprising:

mounting means mounted on the bow, said mounting means having an essentially vertical through passage, said passage comprising a journaling sleeve portion and a spring chamber portion; cap means adapted to close said spring chamber;

arrow support means comprising a one piece arrow support wire having an essentially vertical portion pivotally mounted in said journaling sleeve, and said wire having a substantially horizontal first end extending outwardly from said mounting means, forming said arrow support arm; an upper portion of said vertical portion extending into said spring chamber and forming a spring contact means;

bias means positioned in said spring chamber in communication with said spring contact means and adapted to locate said spring contact means in said initial position and capable of returning said spring contact means to said initial position after being displaced forward, as by an arrow being discharged from the bow, or backward, as by being accidentally snagged on a branch;

said spring chamber includes a front stop surface and a back stop surface;

said bias means includes a first spring means comprising a coil spring wound helically around said upper portion, in a first direction, and abutting against said spring contact means and one of said front and back stop surfaces; and a second spring means comprising a coil spring wound helically around said upper portion, in a direction opposite to said first direction, and abutting against said spring contact means and the other of said front and back stop surfaces, wherein said first spring means is of predetermined tension.

2. The arrow rest of claim 1 in which said mounting means includes means to attach said rest to a conventional cushion plunger.

3. The arrow rest of claim 2 wherein said means to attach includes an essentially horizontal through hole comprising a countersunk mounting screw recess first portion and a substantially square second portion, said first portion adapted to receive a mounting screw, and said second portion adapted to receive a square cushion plunger.

4. The arrow rest of claim 1 wherein said cap means is attached to said mounting means by a thin flexible membrane.

5. The arrow rest of claim 1 wherein said spring contact means comprises an essentially inverted U-shaped portion of said upper portion of said arrow support wire.

6. The arrow rest of claim 1 wherein said second spring means is of higher tension than said first spring means.

7. The arrow rest of claim 1 wherein said second spring means is adapted to stop said spring contact means in said initial position as it is urged by said first spring means.

8. The arrow rest of claim 1 wherein said first spring means and said second spring means act to cushion, each the other during operation.

9. The arrow rest of claim 1 in which said spring contact means will contact said front stop surface or said back stop surface at a predetermined amount of rotation, thus providing maximum rotational limits for said spring contact means.

* * * * *